United States Patent [19]

Johnson et al.

[11] Patent Number: 4,586,657

[45] Date of Patent: May 6, 1986

[54] MALFUNCTION DETECTOR FOR ELECTROSTATIC SPRAYING APPARATUS

[75] Inventors: Graham C. Johnson, Surrey; Timothy J. Noakes, West Sussex, both of England

[73] Assignee: Imperial Chemical Industries PLC, London, England

[21] Appl. No.: 541,122

[22] Filed: Oct. 12, 1983

[30] Foreign Application Priority Data

Nov. 4, 1982 [GB] United Kingdom ..... 8231486
Jan. 12, 1983 [GB] United Kingdom ..... 8300770

[51] Int. Cl.[4] ..... B05B 5/02
[52] U.S. Cl. ..... 239/691; 239/71
[58] Field of Search ..... 239/71, 72, 690, 691, 239/695; 324/133, 452, 453, 455, 457; 340/641, 650, 654, 660, 664; 361/226–228

[56] References Cited

U.S. PATENT DOCUMENTS

| | | | |
|---|---|---|---|
| 2,395,850 | 3/1946 | Colman | 324/133 X |
| 2,610,237 | 9/1952 | Benner | 324/133 X |
| 3,260,616 | 7/1966 | Brewer | 324/453 X |
| 3,739,228 | 6/1973 | Point | 324/452 X |
| 3,831,089 | 8/1974 | Pearce | 340/641 X |
| 3,991,367 | 11/1976 | Chapman et al. | 324/133 |
| 4,335,419 | 6/1982 | Hastings | 239/691 X |
| 4,358,059 | 11/1982 | Coffee | 239/691 |
| 4,433,296 | 2/1984 | Kolibas | 324/133 X |

FOREIGN PATENT DOCUMENTS

| | | | |
|---|---|---|---|
| 0058472 | 8/1982 | European Pat. Off. . | |
| 1569707 | 6/1980 | United Kingdom . | |
| 2038603 | 7/1980 | United Kingdom . | |
| 2073052 | 10/1981 | United Kingdom | 239/690 |

*Primary Examiner*—Johnny D. Cherry
*Attorney, Agent, or Firm*—Cushman, Darby & Cushman

[57] ABSTRACT

A spray malfunction detector system for electrostatic spraying apparatus having a sprayhead connectable to a high voltage source and for directing spray of charged particles of fluid towards an earthed target. The system comprises an earth circuit from the earthed target, a by-pass electrode located in the vicinity of the sprayhead and maintained in use at such a potential as to attract corona discharge from the sprayhead, and a current detector located in the earth circuit between the earthed target and any junction in the earth circuit and by which corona discharge joins the earth circuit from the by-pass electrode.

17 Claims, 6 Drawing Figures

MALFUNCTION DETECTOR FOR ELECTROSTATIC SPRAYING APPARATUS

The present invention relates to spray malfunction detector systems for electrostatic sprayers and especially, but not exclusively, to such systems when used in the spraying of agricultural chemicals e.g., pesticides.

One example of such a sprayer is described in our UK Pat. No. 1,569,707 which discloses an electrically charged sprayhead associated with an earthed field-intensifying electrode. Electrically charged droplets of liquid are directed on to a target crop at earth potential. Such sprayheads may be used in circumstances (e.g., on a tractor boom) where the operator cannot see if the sprayhead is delivering charged droplets of liquid. If such delivery is interrupted, due to exhaustion of liquid supply or other malfunction, areas of crop may go unsprayed leading to serious losses from pest attack.

Two spray malfunction devices are disclosed in our European Patent Application No. 82300303.3. In these, current detectors are located on the high voltage side of a charged sprayhead or adjacent to it. While these are satisfactory under some conditions they can be influenced by corona discharge from the sprayhead (which can occur even when no liquid is being sprayed) and thus fail to indicate when delivery of the spray of charged droplets is interrupted.

It is an object of the present invention to provide a system for detecting the current associated with the spray of charged particles from an electrostatic sprayhead which is less affected by corona discharge than systems previously proposed.

Accordingly, the present invention provides a spray malfunction detector system for electrostatic spraying apparatus having a sprayhead connectable to a high voltage source and being adapted to direct a spray of charged particles of fluid towards an earthed target, the said system comprising an earth circuit from the earthed target, a by-pass electrode located in the vicinity of the sprayhead and maintainable in the use at such a potential as to attract corona discharge from the sprayhead and a current detector located in the earth circuit between the earthed target and any junction in the earth circuit via which corona discharge joins the earth circuit from the by-pass electrode.

According to one embodiment of the invention the by-pass electrode is a field-intensifying electrode adapted to influence the electrostatic field in the vicinity of the sprayhead in use. Electrostatic spraying apparatus having such field-intensifying electrodes is described in our UK Pat. No. 1,569,707.

In an alternative arrangement we provide a spray malfunction detector according to the present invention in which the field-intensifying electrode is at least partially shrouded in electrically insulating material and in which an additional by-pass electrode is provided. The by-pass electrode and field-adjusting electrode (if separately present) are conveniently maintained at earth potential.

The present invention permits the use of a simple current detector of a type which does not discriminate between current carried by the spray of charged particles and current due to corona discharge. In some circumstances, however, it may be advantageous to discriminate between spray current and corona discharge even when a by-pass electrode is present. These circumstances may arise when the sprayhead is heavily contaminated with plant debris causing some corona discharge to reach true earth. In this case a discriminating detector may be used.

The current detector may be a light emitter such as a neon lamp. This can conveniently be adapted to activate a photosensitive device when lit, enabling amplification in order to operate a signal, preferably audio or visual.

Specific embodiments of the invention will now be described with reference to the drawings in which, FIG. 1 is a diagram of a circuit containing a malfunction detector system according to the present invention.

None of the drawings is to scale.

Figure 1:
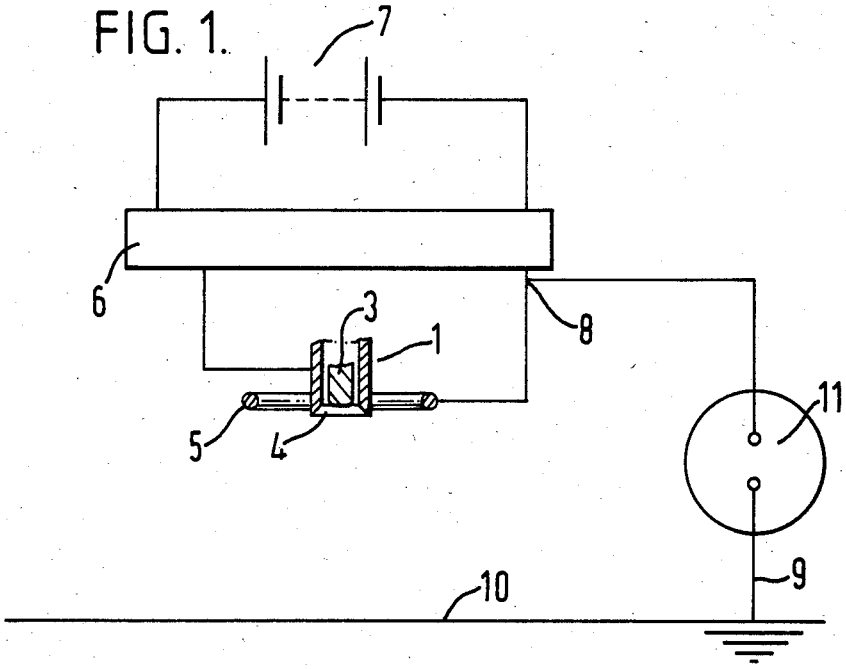
Figure 2:
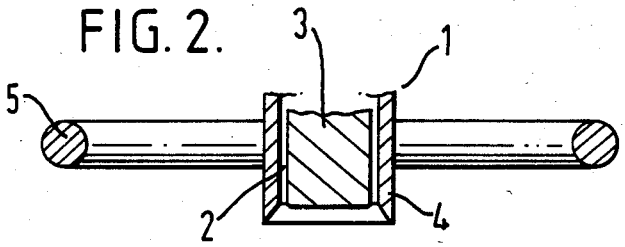
FIG. 2 is vertical section through an electrostatic sprayhead.

Referring to FIGS. 1 and 2 of the drawings an electrostatic sprayhead 1 comprises an annular channel 2 for liquid to be sprayed, between an inner core 3 and an outer wall 4 one or both being made from conducting material. The nozzle 12 formed by elements 2 and 3 is surrounded by, but spaced from, a field intensifying electrode in the form of a bare metal ring 5. The electrode 5 is connected to the earthed side of a high voltage source, comprising an HT inverter 6 and a battery 7, via junction 8. A trailing earth lead 9 makes electrical contact with the "true" earth 10 on which are crops to be sprayed. Located in the earth circuit between earth 10 and junction 8 is a current detector in the form a neon lamp 11.

Figure 6:
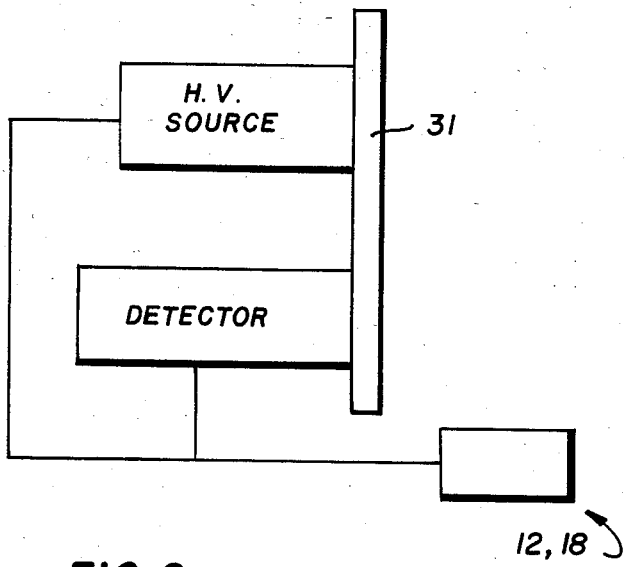
FIG. 6 is a schematic illustration of a connection of various components to frame for carrying on the back of an operator.

The whole apparatus is designed is to be mounted on a frame 31 (see FIG. 6) for carrying upon the back of an operator spraying crops with agricultural chemicals.

In use the sprayhead 1 is supplied with liquid from a container (not shown) and with high voltage of the order of 20 KV to produce a fine spray of charged droplets which are attracted to the crop which is at earth potential: current carried by the droplets then flows in the earth lead 9 and causes the neon lamp 11 to light giving a positive indication when spraying is taking place.

If the spray of charged droplets is interrupted (by exhaustion of liquid supply or nozzle blockage for example) current will cease to flow in the earth lead circuit and the neon lamp will go out. There may be a small residual current due to corona discharge but this will travel direct from the nozzle 12 to the field intensifying electrode 5 since the ions of the discharge are light and mobile and not affected by gravity which gives the heavier liquid droplets a momentum towards "true" earth 10. This residual current will then flow to the earthed side of the high voltage source via junction 8 without interfering with the neon lamp 11.

Figure 3:
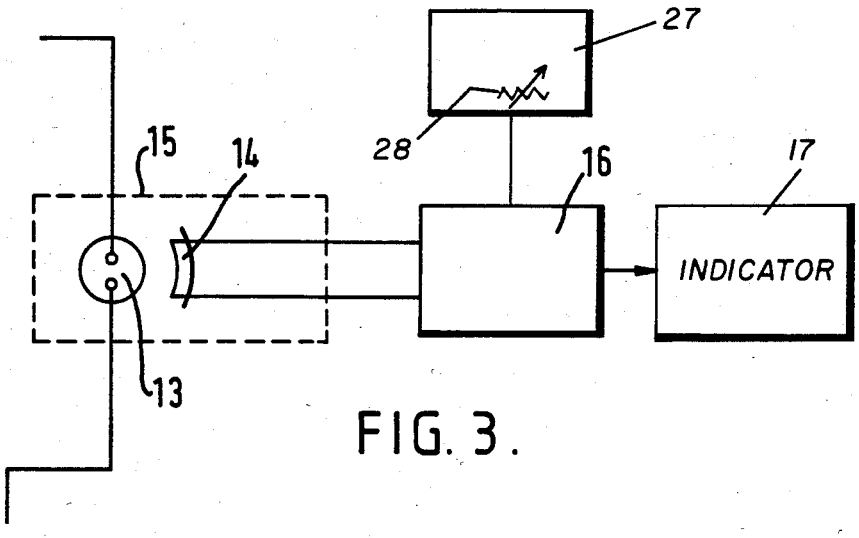
FIG. 3 is a diagram of an amplification circuit for the detector of FIG. 1.

In practice in bright light a neon lamp may not be easily visible to the operator and it may be advantageous to amplify the indication from the neon lamp. One especially effective way of achieving this is illustrated in FIG. 3 in which the neon lamp 13 is located close to a photosensitive semi-conductor 14 in a black container 15. Light excluding potting compound is used for forming the black container and the photosensitive semi-conductor may be a photo-diode, photo-transistor or photo-resistor. The photosensitive semi-conductor is connected to a simple amplifier 16, the output from which may be in the form of a digital yes/no output (specially useful with tractor mounted apparatus) or may be used to activate a visual or audio indicator 17.

An optional additional element is a tuning circuit 27 including a variable resistance 28 associated with the amplifier 16 which enables the sensitivity of the detector to be "tuned" if need be (e.g., so that it rejects both no flow and a preset low flow), as shown schematically in FIG. 3.

The operator thus receives a positive indication as to whether the spray is functioning correctly, or not, even when the sprayhead itself is out of sight as is often the case with back-carried apparatus.

The arrangement illustrated in FIG. 3 has the advantage that semi-conductor components such as amplifier, digital logic, etc. are opto-isolated from the HT circuit and thus rendered less vulnerable to any fluctuations, spikes, etc. which may occur.

In some constructions of electrostatic sprayhead either there is no earthed field-intensifying electrode or, if present, it is shrouded in insulating material. The latter condition is especially likely in the case of tractor-mounted apparatus. In these circumstances corona discharge, formed when no liquid is flowing but the nozzle is still charged to a high voltage, may find its way to "true" earth. This is believed to be because the surface of the insulating material surrounding the field-intensifying electrode becomes charged by bombardment with air ions and tends to repel subsequent ions.

This effect can cause the current detector to register current even when no spray is being delivered.

Figure 4:
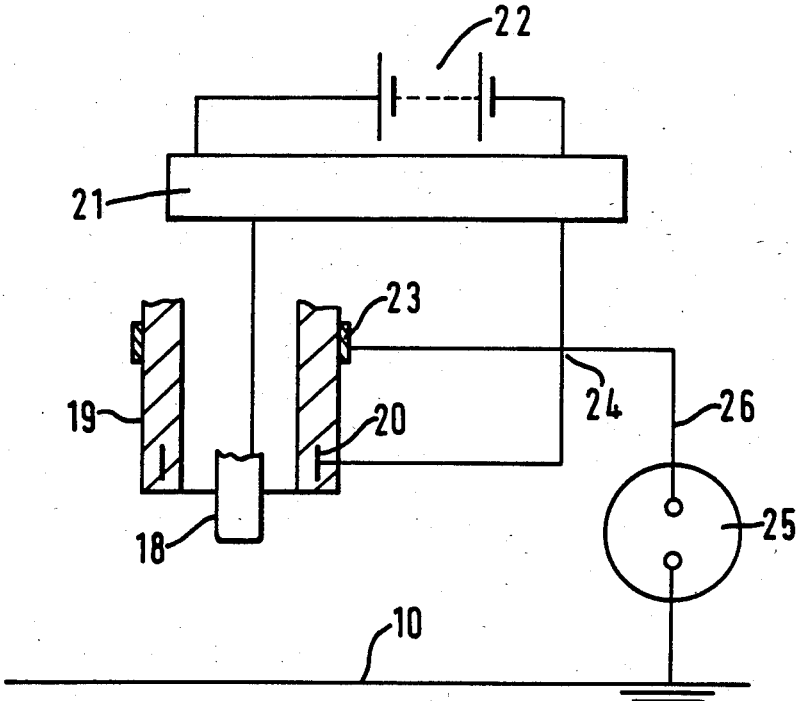
FIG. 4 is a diagram of a system having an additional by-pass electrode as provided by the invention.

A way of overcoming this problem according to a further aspect of the present invention is illustrated in FIG. 4 in which a spray nozzle 18 is mounted within an outer housing 19 of insulating plastics material. A field-intensifying electrode 20 is buried in the wall of the housing so as to be fully shrouded by the insulating material from the nozzle 18 which is connected to a source of high voltage consisting of an HT generator 21 and a battery 22. Electrode 20 is connected to the earthed side of the high voltage source. A second earthed electrode 23 in the form of a bare metal ring is attached to the outside of the housing 19 about 15 to 20 cm above the electrode 20. Electrode 23 is connected to the earth side of the high voltage source via junction 24. A current detector in the form of a neon lamp 25 is located in the earth circuit 26 between "true" earth 10 and junction 24.

The location of by-pass electrode 23 in this example is chosen so as not to influence the operation of field-intensifying electrode 20. The location may be varied however provided the effect of the field in the vicinity of the nozzle is kept with acceptable limits or otherwise allowed for. Its structure and form may also be varied and multiple electrodes used if desired provided a by-pass for corona discharge is obtained.

Figure 5:
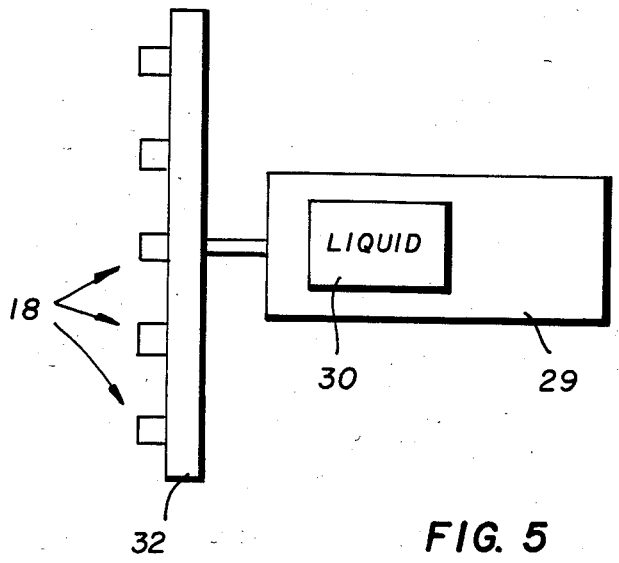
FIG. 5 is a schematic illustration showing the connection of sprayheads and liquid source to a tractor.

The complete apparatus is mounted on a tractor 29 (see FIG. 5) and in operation spraying crops with agricultural chemicals the tractor driver opens a supply of liquid 30 to the sprayhead 18 and connects the sprayhead to the high voltage source 21. A spray of fine charged droplets is formed and attracted to the crop which is at earth potential. A current is thus generated in the earth return circuit 26 sufficient to light neon lamp 25. The indication given by lamp 25 may be amplified as illustrated in FIG. 3 and caused to activate an audio or visual signal in the driver's cab, thus giving a positive indication of the correct functioning of the sprayhead. If the spray ceases, stray residual current such as that caused by corona discharge will flow to electrode 23, thus by-passing the earth circuit between "true" earth 10 and junction 24 and avoiding the risk that lamp 25 may continue to indicate current in the absence of spray.

The present invention therefore provides a cheap, simple and robust way of detecting spray malfunction. It responds directly to the current actually carried by the spray and reduces or eliminates interference from corona discharge thus having a greater degree of fail-safe capability and permitting the use of simple, robust devices which do not discriminate between different sources of current. In the aspect illustrated with reference to FIG. 3 it is possible to opto-isolate vulnerable components from the HT circuit thus safeguarding them against fluctuations or spikes in that circuit.

It will be apparent to one skilled in the art that various modifications to the apparatus may be made in detail without departing from the scope of the invention. For example other means of current detection and amplification may be used. In this event it will be clear that if the detector is sensitive to induced currents it should be located physically as well as electrically sufficiently far away from sources of stray current, such as corona discharge in the vicinity of the nozzle, so as to keep interferance within acceptable limits. It may on the other hand be found convenient to locate a simple detector of the type which does not respond to induced currents close to the sprayhead or other parts of the system to provide a compact assembly.

The system of the present invention may also be used to detect malfunctions when spraying liquids other than agricultural chemicals e.g., paint, and with other forms of sprayhead e.g., those of linear slot configuration or spinning discs.

When mounted on a tractor 29 the apparatus may comprise several sprayheads 18 mounted on a boom 32 carried behind the tractor. In this case each sprayhead should be associated with a spray malfunction detector system if interruption of spray from individual sprayheads is to be detected.

We claim:

1. A spray malfunction detector system for electrostatic spraying apparatus having a sprayhead including a nozzle, and connectable to a high voltage source and for directing a spray of charged particles of fluid towards an earthed target, said system comprising: an earth circuit from the earthed target, the circuit having one or more junctions; a by-pass electrode located in the vicinity of the sprayhead and maintained in use at such an electrical potential as to attract corona discharge from the sprayhead; and a current detector means located in the earth circuit between the earthed target and a junction in the earth circuit and by which corona discharge from the by-pass electrode joins the earth circuit.

2. A spray malfunction detector system as claimed in claim 1 in which the by-pass electrode is a field-intensifying electrode means for influencing the electrostatic field in the vicinity of the nozzle and is maintained in use at a potential which is low relative to that of the sprayhead.

3. A spray malfunction detector system as claimed in claim 1 wherein said by-pass electrode comprises a field-intensifying electrode means for influencing the electrostatic field in the vicinity of the sprayhead in use, and wherein said field-intensifying electrode means is at least partially shrouded in electrically insulating material; and further comprising at least one by-pass electrode in addition to said field-intensifying electrode means.

4. A spray malfunction detector system as claimed in claim 1 wherein said by-pass electrode is at earth potential.

5. A spray malfunction detector system as claimed in any one of claims 1 to 4 in which said current detector means comprises a part of the earth circuit so as to detect current in the circuit directly.

6. A spray malfunction detector system as recited in claims 2 or 3 wherein said field-intensifying electrode means is at earth potential.

7. A spray malfunction detector system as claimed in claim 1 wherein said current detector means emits light when a current passes.

8. A spray malfunction detector as claimed in claim 7 wherein said current detector means is a neon lamp.

9. A spray malfunction detector as claimed in claim 7 wherein said current detector means activates a photosensitive device when lit.

10. A spray malfunction detector system as claimed in claim 9 further comprising an amplifier for the output from the photosensitive device and an indicator operated by the amplified output.

11. A spray malfunction detector system as claimed in claim 10 wherein said current detector means is associated with a tuning circuit which causes the current detector means to respond only to currents within predetermined limits.

12. A spray malfunction detector system as claimed in claim 11 wherein the tuning circuit contains a variable resistance associated with the amplifier.

13. A spray malfunction detector system as recited in claims 7 or 12 wherein said current detector means comprises a part of the earth circuit so as to detect current in the circuit directly.

14. A spray malfunction detector system as recited in claim 1 in combination with a source of agricultural chemicals in liquid form, said sprayhead operatively connected to said source of agricultural chemicals in liquid form for the spraying thereof.

15. A spray malfunction detector system as recited in claim 1 further comprising a frame mountable on an operator's back, said sprayhead, high voltage source, and malfunction detector system mounted on said frame.

16. A spray malfunction detector system as recited in claim 1 mounted on a tractor.

17. A spray complex comprising a plurality of sprayheads, each including a nozzle, for electrostatic spraying; each sprayhead connectable to a high voltage source and for directing a spray of charged particles of fluid toward an earthed target, and each sprayhead including a spray malfunction detector system; each system comprising: an earth circuit from the earthed target, the circuit having one or more junctions; a by-pass electrode located in the vicinity of the sprayhead and maintained in use at such an electrical potential as to attract corona discharge from the sprayhead; and a current detector means located in the earth circuit between the earthed target and a junction in the earth circuit and for causing corona discharge from the by-pass electrode to join the earth circuit.

* * * * *